United States Patent [19]

Taniguchi et al.

[11] Patent Number: 4,983,446

[45] Date of Patent: Jan. 8, 1991

[54] THERMAL IMAGE TRANSFER RECORDING MEDIUM

[75] Inventors: Keishi Taniguchi, Susono; Junko Yamaguchi, Shizuoka, both of Japan

[73] Assignee: Ricoh Company, Ltd., Tokyo, Japan

[21] Appl. No.: 301,830

[22] Filed: Jan. 26, 1989

[30] Foreign Application Priority Data

| | | | |
|---|---|---|---|
| Jan. 28, 1988 | [JP] | Japan | 63-15897 |
| Apr. 1, 1988 | [JP] | Japan | 63-77995 |
| Jun. 30, 1988 | [JP] | Japan | 63-160996 |

[51] Int. Cl.[5] ..... B41M 5/26

[52] U.S. Cl. ..... 428/216; 428/195; 428/335; 428/336; 428/480; 428/484; 428/488.4; 428/913; 428/914

[58] Field of Search ..... 428/195, 484, 488.1, 428/488.4, 913, 914, 212, 213, 215, 216, 334–336, 480

[56] References Cited

U.S. PATENT DOCUMENTS

| | | | |
|---|---|---|---|
| 4,707,395 | 11/1987 | Ueyama et al. | 428/488.4 |
| 4,756,950 | 7/1988 | Matsushita et al. | 428/195 |
| 4,777,079 | 10/1988 | Nagamoto et al. | 428/488.4 |
| 4,828,922 | 5/1989 | Koshizuka et al. | 428/484 |

*Primary Examiner*—Pamela R. Schwartz

*Attorney, Agent, or Firm*—Oblon, Spivak, McClelland, Maier & Neustadt

[57] ABSTRACT

A thermal image transfer recording medium comprising a substrate and a thermally transferable ink layer comprising as the main components a coloring agent and a saturated linear polyester resin.

14 Claims, No Drawings

THERMAL IMAGE TRANSFER RECORDING MEDIUM

BACKGROUND OF THE INVENTION

This invention relates to a thermal image transfer recording medium capable of producing highly reliable transferred images having excellent solvent and friction resistance.

Recently, a thermal imprint recording method using a thermal head has been widely utilized. This is because a thermal head is advantageous in that it does not produce noise, its production cost is relatively inexpensive, it can be made small-sized, and it is easily maintainable. In addition to the above, the transferred images produced by a thermal head are very stable.

Heretofore, a thermal image transfer recording medium which comprises a substrate such as a condenser sheet and a polyester film, which has high thermal conductivity and thermostability, and a thermofusible color layer formed thereon containing thermofusible materials such as natural and synthetic waxes, colorants, and thermoplastic resins has been used in the thermal imprint recording method.

However, images transferred from the above conventional recording medium to a recording sheet tend to fade when in contact with solvents such as alcohol, kerosene, machine oil and petroleum, or rubbed with a cloth impregnated with the same.

Further, the transferred images readily lift off the recording sheet if rubbed with corrugated cardboard or scratched by a pen scanner which is used for reading bar codes.

SUMMARY OF THE INVENTION

Accordingly, it is an object of the present invention to provide an improved thermal image transfer recording medium which is capable of yielding uniform images having high image density, high solvent resistance, friction and scratch resistance.

The foregoing object of the present invention can be attained by a thermal image transfer recording medium which comprises a substrate and a thermally transferrable ink layer comprising as the main components a coloring agent and a saturated linear polyester resin having a low melting point or a softening point, the ink layer being formed on the substrate.

DETAILED DESCRIPTION OF THE PREFERRED EMBODIMENTS

Compounds represented by the following general formulae (I) and (II) are preferably used as the above described saturated linear polyester resin:

$$-(OC-R^1-COO-R^2-O-)- \quad (I)$$

in which $R^1$ and $R^2$ independendly represent a saturated linear aliphatic hydrocarbon group having 2 to 18 carbon atoms, and the total number of carbon atoms contained in $R^1$ and $R^2$ is 8 or more; and $$-(OC-R^3-COO-R^4-O)- \quad (II)$$

in which $R^3$ represents a saturated linear aliphatic hydrocarbon group, $R^4$ represents a saturated linear aliphatic hydrocarbon group containing ether groups or a saturated linear aliphatic hydrocarbon group, and the molar ratio of the saturated linear aliphatic hydrocarbon group containing ether groups to the saturated linear aliphatic hydrocarbon group represented by $R^4$ in the entire polyester resin is 1–100:99–0.

In view of preservation stability and thermosensitivity, the polyester resins (I) and (II) having a melting point or a softening point of 50° to 200° C., preferably 50° to 150° C., and more preferably 60° to 120° C., are favorably used. Further, considering image transfer ability, solvent, friction and scratch resistance, and thermosensitivity, the polyester resins (I) and (II) having a number average molecular weight of 3,000 to 30,000, preferably 4,000 to 20,000, determined by gel permeation chromatography, are suitable.

The saturated linear polyester resin for use in the present invention may be synthesized in the general synthetic manner of polyesters. For example, it can be prepared by a condensation reaction between a dihydroxy compound and a dibasic acid.

The following compounds are examples of the polyester resins (I). However, the present invention is not restricted to these polyester reins.

| Polyester Resin No. | Chemical Formula |
|---|---|
| (1) | $-[OC(CH_2)_4COO(CH_2)_4O]-$ |
| (2) | $-[OC(CH_2)_2COO(CH_2)_{10}O]-$ |
| (3) | $-[OC(CH_2)_6COO(CH_2)_4O]-$ |
| (4) | $-[OC(CH_2)_6COO(CH_2)_6O]-$ |
| (5) | $-[OC(CH_2)_8COO(CH_2)_6O]-$ |
| (6) | $-[OC(CH_2)_6COO(CH_2)_8O]-$ |
| (7) | $-[OC(CH_2)_8COO(CH_2)_8O]-$ |
| (8) | $-[OC(CH_2)_{10}COO(CH_2)_8O]-$ |
| (9) | $-[OC(CH_2)_8COO(CH_2)_{10}O]-$ |
| (10) | $-[OC(CH_2)_{10}COO(CH_2)_6O]-$ |
| (11) | $-[OC(CH_2)_{10}COO(CH_2)_{10}O]-$ |
| (12) | $-[OC(CH_2)_4COO(CH_2)_{10}O]-$ |
| (13) | $-[OC(CH_2)_{12}COO(CH_2)_{12}O]-$ |
| (14) | $-[OC(CH_2)_{18}COO(CH_2)_{12}O]-$ |
| (15) | $-[OC(CH_2)_{12}COO(CH_2)_{18}O]-$ |
| (16) | $-[OC(CH_2)_{18}COO(CH_2)_{18}O]-$ |
| (17) | $-[OC(CH_2)_4COO(CH_2)_{12}O]-$ |
| (18) | $-[OC(CH_2)_4COO(CH_2)_{18}O]-$ |
| (19) | $-[OC(CH_2)_{18}COO(CH_2)_3O]-$ |
| (20) | $-[OC(CH_2)_{18}COO(CH_2)_5O]-$ |
| (21) | $-[OC(CH_2)_{10}COO(CH_2)_7O]-$ |
| (22) | $-[OC(CH_2)_7COO(CH_2)_{12}O]-$ |
| (23) | $-[OC(CH_2)_5COO(CH_2)_{10}O]-$ |
| (24) | $-[OC(CH_2)_7COO(CH_2)_7O]-$ |

Commercially available polyester resins such as VYLON-200, VYLON-300, VYLON-600, VYLON-630, VYLON-5500, GM-400, GM-900 (made by Toyobo Co., Ltd.), TP-217 and TP-220 (made by The Nippon Synthetic Chemical Industry Co., Ltd.) are also employable as the polyester resin (I).

The following compounds are examples of the polyester resin (II). However, the present invention is not restricted to these polyester resins.

| Polyester Resin No. | Chemical Formula |
|---|---|
| (25) | $-[OC(CH_2)_{18}COOC_2H_4OC_2H_4OC_2H_4OC_2H_4O]-$ |
| (26) | $-[OC(CH_2)_{18}COOC_2H_4OC_2H_4O]-$ |
| (27) | $-[OC(CH_2)_8COO(PEG\ \#6000)O]-$ (PEG #6000 = polyethylene glycol having a molecular weight of about 6,000) |
| (28) | $-[OC(CH_2)_{10}COOC_2H_4OC_2H_4O]-$ |
| (29) | $-[OC(CH_2)_{18}COOC_2H_4OC_2H_4OC_2H_4O]-$ |
| (30) | $-[OC(CH_2)_{10}COO-R_4-O]-$ ($R_4$ = a copolymer of 95 mol % of $(CH_2)_{10}$ and 5 mol % of $C_2H_4OC_2H_4OC_2H_4OC_2H_4$) |
| (31) | $-[OC(CH_2)_{10}COO-R_4-O]-$ ($R_4$ = a copolymer of 90 mol % of $(CH_2)_{10}$ and 10 mol % of $C_2H_4OC_2H_4OC_2H_4OC_2H_4$) |

-continued

| Polyester Resin No. | Chemical Formula |
|---|---|
| (32) | —[OC($CH_2$)$_{10}$COO—$R_4$—O]— ($R_4$ = a copolymer of 85 mol % of ($CH_2$)$_{10}$ and 15 mol % of $C_2H_4OC_2H_4OC_2H_4OC_2H_4$) |
| (33) | —[OC($CH_2$)$_{18}$COO—$R_4$—O]— ($R_4$ = a copolymer of 30 mol % of PEG #1000 (polyethylene glycol having a molecular weight of about 1,000) and 70 wt % of ($CH_2$)$_{10}$) |
| (34) | —[OC($CH_2$)$_{18}$COO—$R_4$—O]— ($R_4$ = a copolymer of 20 mol % of PEG #1000 (polyethylene glycol having a molecular weight of about 1,000) and 80 wt % of ($CH_2$)$_{10}$) |
| (35) | —[OC($CH_2$)$_{18}$COO—$R_4$—O]— ($R_4$ = a copolymer of 50 mol % of ($CH_2$)$_{10}$ and 50 mol % of $C_2H_4OC_2H_4OC_2H_4OC_2H_4$) |
| (36) | —[OC($CH_2$)$_{18}$COO—$R_4$—O]— ($R_4$ = a copolymer of 99 mol % of ($CH_2$)$_{10}$ and 1 mol % of PEG #6000 (polyethylene glycol having a molecular weight of about 6,000)) |
| (37) | —[OC($CH_2$)$_{18}$COO—$R_4$—O]— ($R_4$ = a copolymer of 80 mol % of ($CH_2$)$_{10}$ and 20 mol % of $C_2H_4OC_2H_4OC_2H_4OC_2H_4$) |
| (38) | —[OC($CH_2$)$_{18}$COO—$R_4$—O]— ($R_4$ = a copolymer of 50 mol % of ($CH_2$)$_{10}$ and 50 mol % of $C_2H_4OC_2H_4$) |
| (39) | —[OC($CH_2$)$_{18}$COO—$R_4$—O]— ($R_4$ = a copolymer of 60 mol % of ($CH_2$)$_{10}$ and 40 mol % of $C_2H_4OC_2H_4OC_2H_4OC_2H_4$) |
| (40) | —[OC($CH_2$)$_{18}$COO—$R_4$—O]— ($R_4$ = a copolymer of 70 mol % of ($CH_2$)$_{10}$ and 30 mol % of $C_2H_4OC_2H_4OC_2H_4OC_2H_4$) |
| (41) | —[OC($CH_2$)$_{18}$COO—$R_4$—O]— ($R_4$ = a copolymer of 99 mol % of ($CH_2$)$_{10}$ and 1 mol % of PEG #4000 (polyethylene glycol having a molecular weight of about 4,000)) |

All the above-enumerated polyester resins are saturated aliphatic polyesters having a melting point or a softening point of 50° to 200° C. Further, since the polyester resins have a saturated linear aliphatic hydrocarbon group containing relatively long hydrocarbon moieties of dibasic acid and of diol, the crystallinity of the polymers themselves are high. Therefore, the polymers are sufficiently hard, and images transferred from an image transfer layer containing such polyester resins have high friction and scratch resistance. In addition, the transferred images are not solvent eluted.

The polyester resin (II) contains ether groups to a suitable amount, so that surface activity of the resin against a transfer sheet becomes high, when it is thermally fused. Consequently, the resin is well wetted and spread on an image transfer sheet. The polyester resin (II) thus has a high image transfer ratio and good thermosensitivity.

Although it is not requisite at all, waxes having a penetration of 1 or less can be additionally incorporated into the ink layer of the present invention. Examples of such waxes include carnauba wax, polyethylene wax, Fischer Tropsch wax and the like. In the case where the polyester resin and the wax are made into an ink layer in combination, the preferable ratio of these two components is 20/80 to 80/20 on a weight basis.

When the ink layer contains such a wax, images can be transferred from the ink layer even by application of low thermal energy. That is, an ink layer containing such a wax has high thermosensitivity. Further, the waxes have a low melting point compared with the resins, and the ink layer containing the waxes sensitively responds to signals, so that clear and accurate images can be produced. Additionallly, since the waxes have a penetration of 1 or less at 25° C. and are relatively hard, thermal image transfer recording media having high friction and scratch resistance can be obtained.

Coloring agents for use in the present invention are selected from inorganic and oragnic dyes and pigments having proper characteristics as a recording material. For instance, those materials which reveal a sufficient coloring condensation and are not faded or discolored by external conditions such as light, heat and humidity are preferred. Further, materials which are normally colorless but develop color upon application of heat, and materials which develop color when in contact with a material coated on a transfer sheet are also employable.

The above coloring agents are preferably incorporated in the ink layer in an amount of 15 to 75 wt. %, preferably 30 to 50 wt. %, of the total ink components, in view of the dispersion of the coloring agents, and the inherent properties of the polyester resin employed in the ink layer such as high solvent and friction resistance. Incorporation of the coloring agent in an amount in the above range allows good coloring agent dispersion in the ink layer, and the ink layer can also be made thin.

The following components can be optionally added to the ink layer: softening agents such as mineral oils and vegetable oils; thermal conductivity-improving agents such as metal powders; pigments such as micro silica, calcium carbonate and kaolin; image transfer-improving agents such as polyvalent alcohols; solvents; and diluents.

By using solvents or diluents, an ink layer forming composition can be converted into an ink composition usable in ordinary printing. Examples of such solvents and diluents include toluene, xylene, ethyl acetate, methyl ethyl ketone, acetone, methanol, ethanol, isopropanol, ethyl cellosolve, cyclohexane and the like.

As a substrate of the thermal transfer recording medium of the present invention, a film of plastics having relatively high thermoresistance such as polyester, polycarbonate, triacetylcellulose, nylon and polyimide; glassine paper; condenser paper; metal foil; and composites thereof are usable.

Examples of the composites include a composite consisting of aluminum and paper, paper coated with vacuum evaporated metal, and a plastic film coated with vacuum evaporated metal.

A substrate having a thickness of about 2 to 15 μm is preferably used in the case of employing a thermal head to transfer the images. However, substrates having any thicknesses are usable when a thermal source capable of selectively heating the ink layer, such as laser beams, is employed. In the case where a thermal head is employed, a heat-resistant protective layer made of silicone resin, fluorine resin, polyimide resin, epoxy resin, phenol resin, melamine resin, or nitrocellulose, can be formed on a substrate which contacts with the thermal head so as to improve the heat resistance of the substrate. Further, even such materials that have never been used as substrates are made to be employable in combination with such a heat-resistant protective layer.

In addition to the above, a peel-off layer can be interposed between the substrate and the thermally transferable ink layer so that the fused ink layer can easily lift off the substrate when images are transferred from the ink layer. Such materials which have a differential thermal analysis peak at 120° C. or less and which are readily fused upon application of heat into a liquid having a low viscosity are usable as a peel-off layer of the present invention.

Examples of such materials include natural waxes such as beeswax, whale wax, candelilla wax, carnauba wax, rice bran wax, montan wax, and ozocerite; petroleum waxes such as parrafin wax and microcrystalline wax; various modified waxes; hydrogen waxes; and long chain aliphatic acids. Of these, carnauba wax is preferable. This is because the peel-off layer and the ink layer are fused and partially admixed when images are thermally transferred, so that it is proper to use a hard and slippery material like carnauba wax in the peel-off layer.

A preferable range of the thickness of the peel-off layer is from 0.1 to 10 μm, preferably from 1 to 5 μm.

A method for preparing a thermal image transfer recording medium by using the above described substrate, coloring agent and compounds is described below.

Namely, the coloring agent and the above described compounds are mixed and kneaded to prepare an ink layer-forming composition. The thus obtained composition is applied to one surface of the substrate in accordance with one of the following manners of application: hot-melt coating, photogravure coating, roller coating, air-knife coating, wire-bar coating, and printing method such as photogravure printing, gravure off-set printing and silk screen printing.

A proper thickness of the ink layer is in the range of from 0.1 to 30 μm, preferably from 1 to 20 μm, for obtaining transferred images with sufficiently deep color, good thermal conductivity, and for attaining complete image transfer.

This invention will now be explained more specifically by referring to Examples. However, the following examples should not be construed as limiting the present invention.

SYNTHESIS EXAMPLE 1

26.66 g (0.153 mol) of 1,10-decanediol, 30.34 g (0.15 mol) of sebacic acid, 250 ml of toluene and two droplets of concentrated sulfuric acid were placed in a 500 ml Erlenmeyer flask, and the flask was equipped with a distilling receiver with stopcock and a reflux condenser. The above compounds were brought into a reaction for 8 hours at an elevated temperature while removing generated water by refluxing the toluene, and followed by cooling of the reaction mixture. Thereafter, the toluene was distilled off under reduced pressure, and the precipitated white solid material was crushed into powder. The resultant powder was washed with water and dried. The thus obtained dried powder was placed in a 300 ml egg plant type flask, and brought into a reaction at 190° to 200° C. for 8 hours under reduced pressure of 0.5 to 1 mm Hg. After completion of the reaction, the flask was cooled, and then it was broken to obtain 43.4 g of a milky white resinous material, Polyester Resin (9).

The resin had a melting point of 73° to 81° C. and a number average molecular weight of 6,500 determined by gel permeation chromatography.

SYNTHESIS EXAMPLE 2

Synthesis Example 1 was repeated except that 26.66 g (0.153 mol) of 1,10-decanediol employed in Synthesis Example 1 was replaced by 18.08 g (0.153 mol) of hexamethylene glycol, whereby Polyester Resin (5) having a melting point of 67° to 71° C. was prepared.

SYNTHESIS EXAMPLE 3

Synthesis Example 1 was repeated except that 26.66 g (0.153 mol) of 1,10-decanediol employed in Synthesis Example 1 was replaced by 22.37 g (0.153 mol) of octamethylene glycol, whereby Polyester Resin (7) having a melting point of 74° to 81° C. was prepared.

SYNTHESIS EXAMPLE 4

Synthesis Example 1 was repeated except that 26.66 g (0.153 mol) of 1,10-decanediol and 30.34 g (0.15 mol) of sebacic acid employed in Synthesis Example 1 were replaced by 18.08 g (0.153 mol) of hexamethylene glycol and 34.55 g (0.15 mol) of decamethylene dicarboxylic acid, whereby Polyester Resin (10) having a melting point of 68° to 74° C. was prepared.

SYNTHESIS EXAMPLE 5

Synthesis Example 1 was repeated except that 26.66 g (0.153 mol) of 1,10-decanediol and 30.34 g (0.15 mol) of sebacic acid employed in Synthesis Example 1 were respectively replaced by 26.66 g [0.153 mol) of decamethylene glycol and 34.55 g (0.15 mol) of decamethylene dicarboxylic acid, whereby Polyester Resin (11) having a melting point of 76° to 83° C. was prepared.

SYNTHESIS EXAMPLE 6

Synthesis Example 1 was repeated except that 26.66 g (0.153 mol) of 1,10-decanediol and 30.34 g (0.15 mol) of sebacic acid employed in Synthesis Example 1 were respectively replaced by 26.66 g (0.153 mol) of decamethylene glycol and 21.92 g (0.15 mol) of adipic acid, whereby Polyester Rresin (12) having a melting point of 72° to 74° C. was prepared.

SYNTHESIS EXAMPLE 7

Synthesis Example 1 was repeated except that 26.66 g (0.153 mol) of 1,10-decanediol and 30.34 g (0.15 mol) of sebacic acid employed in Synthesis Example 1 were respectively replaced by 26.66 g (0.153 mol) of decamethylene glycol and 17.71 g [0.15 mol) of succinic acid, whereby Polyester Resin (2) having a melting point of 68° to 70° C. was prepared.

SYNTHESIS EXAMPLE 8

17.13 g (0.05 mol) of 1,18-octadecane dicarboxylic acid, 7.55 g (0.0503 mol) of triethylene glycol, 200 ml of toluene and two droplets of concentrated sulfuric acid were placed in a 500 ml Erlenmeyer flask, and the flask was equipped with a distilling receiver with stopcock and a reflux condencer. The above compounds were brought into a reaction for 8 hours at an elevated temperature while removing generated water by refluxing the toluene. Thereafter, the toluene was distilled off under reduced pressure, and the precipitated white solid material was crushed into powder, followed by washing with water and dried. The thus obtained dried powder was placed in a 300 ml egg plant type flask, and brought into a reaction at 190° to 200° C. for 8 hours under reduced pressure of 0.5 to 1 mm Hg. After completion of the reaction, the flask was cooled, and then it was broken to obtain 20.3 g of a milky white resinous material, Polyester Resin (29).

The thus obtained resin had a melting point of 67° to 72° C. and a number average molecular weight of 6,470 determined by gel permeation chromatography.

SYNTHESIS EXAMPLE 9

Synthesis Example 8 was repeated except that 17.13 g (0.05 mol) of 1,18-octadecane dicarboxylic acid and 7.55 g (0.0503 mol) of triethylene glycol employed in Synthesis Example 8 were replaced by 11.52 g (0.05 mol) of decamethylene dicarboxylic acid, 7.89 g (0.0453 mol) of decamethylene glycol and 0.45 g (0.005 mol) of tetraethylene glycol, whereby Polyester Resin (31) having a melting point of 68° to 70° C. was prepared.

SYNTHESIS EXAMPLE 10

Synthesis Example 8 was repeated except that 7.55 g (0.0503 mol) of triethylene glycol employed in Synthesis Example 8 was replaced by 15.10 g [0.0151 mol) of PEG #1000 (polyethylene glycol having a molecular weight of 1,000) and 6.13 g (0.0352 mol) of decamethylene glycol, whereby Polyester Resin (33) having a melting point of 65° to 68° C. was prepared.

SYNTHESIS EXAMPLE 11

Synthesis Example 8 was repeated except that 7.55 g (0.0503 mol) of triethylene glycol employed in Synthesis Example 8 was replaced by 4.39 g (0.0252 mol) of decamethylene glycol and 2.27 g (0.0252 mol) of tetraethylene glycol, whereby Polyester Resin (35) having a melting point of 60° to 62° C. was prepared.

SYNTHESIS EXAMPLE 12

Synthesis Example 8 was repeated except that 7.55 g (0.0503 mol) of triethylene glycol employed in Synthesis Example 8 was replaced by 8.68 g (0.0498 mol) of decamethylene glycol and 3.0 g (0.0005 mol) of PEG #6000 (polyethylene glycol having a molecular weight of 6,000), whereby Polyester Resin (36) having a melting point of 75° to 80° C. was prepared.

EXAMPLE 1

To the surface of a 3.5 μm thick polyester film with a polyimide thermoresistant layer as backing, an ink layer-forming composition of the following formulation was applied by using a wire-bar, and dried. Thus, Thermal Image Transfer Recording Medium No. 1 according to the present invention, having a thermofusible ink layer with a thickness of 3.5 μm, was prepared.

| Formulation of Ink Layer-Forming Composition: | |
|---|---|
| Carbon Black | 0.99 g |
| Polyester Resin (9), prepared in Synthesis Example 1 | 2.01 g |
| Toluene | 17.0 g |

EXAMPLE 2

Example 1 was repeated except that Polyester Resin (9) employed in Example 1 was replaced by Polyester Resin (5) prepared in Synthesis Example 2, whereby Thermal Image Transfer Recording Medium No. 2 according to the present invention was prepared.

EXAMPLE 3

Example 1 was repeated except that Polyester Resin (9) employed in Example 1 was replaced by Polyester Resin (7) prepared in Synthesis Example 3, whereby Thermal Image Transfer Recording Medium No. 3 according to the present invention was prepared.

EXAMPLE 4

Example 1 was repeated except that Polyester Resin (9) employed in Example 1 was replaced by Polyester Resin (10) prepared in Synthesis Example 4, whereby Thermal Image Transfer Recording Medium No. 4 according to the present invention was prepared.

EXAMPLE 5

Example 1 was repeated except that Polyester Resin (9) employed in Example 1 was replaced by Polyester Resin (11) prepared in Synthesis Example 5, whereby Thermal Image Transfer Recording Medium No. 5 according to the present invention was prepared.

EXAMPLE 6

Example 1 was repeated except that Polyester Resin (9) employed in Example 1 was replaced by Polyester Resin (12) prepared in Synthesis Example 6, whereby Thermal Image Transfer Recording Medium No. 6 according to the present invention was prepared.

EXAMPLE 7

Example 1 was repeated except that Polyester Resin (9) employed in Example 1 was replaced by Polyester Resin (2) prepared in Synthesis Example 7, whereby Thermal Image Transfer Recording Medium No. 7 according to the present invention was prepared.

COMPARATIVE EXAMPLE 1

Example 1 was repeated except that Polyester Resin (9) employed in Example 1 was replaced by a paraffin wax Trademark "HNP-10" made by Nippon Seiro Co., Ltd.), whereby Comparative Thermal Image Transfer Recording Medium No. 1 was prepared.

COMPARATIVE EXAMPLE 2

Example 1 was repeated except that Polyester Resin (9) employed in Example 1 was replaced by a saturated branched aliphatic polyester resin (Trademark "NICHIGO POLYESTAR TP-219" made by The Nippon Synthetic Chemical Industry Co., Ltd.) having a melting point of 82° to 95° C., whereby Comparative Thermal Image Transfer Recording Medium No. 2 was prepared.

COMPARATIVE EXAMPLE 3

Example 1 was repeated except that Polyester Resin (9) employed in Example 1 was replaced by an ethylenevinylacetate copolymer (Trademark "EVAFLEX-210" made by Du Pont-Mitsui Polychemicals Co., Ltd.), whereby Comparative Thermal Image Transfer Recording Medium No. 3 was prepared.

SOLVENT RESISTANCE TEST

The image transfer layer of each of the above-prepared thermal image transfer recording media was brought into close contact with a sheet of high-quality paper, and images were transferred thereto using a thermal transfer printer by application of a thermal energy of 0.6 mJ/dot.

In order to evaluate the solvent resistance of the transferred images, the transferred images were strongly rubbed reciprocatingly 10 times with a cotton-tipped rod impregnated with ethanol, kerosene, engine oil and car wax, respectively. The results are shown in Table 1.

TABLE 1

| | Recording Medium | Ethanol Resistance | Kerosene Resistance | Engine Oil Resistance | Car Wax Resistance |
|---|---|---|---|---|---|
| Ex. 1 | No. 1 | O | O | O | O |
| Ex. 2 | No. 2 | O | O | O | O |
| Ex. 3 | No. 3 | O | O | O | O |
| Ex. 4 | No. 4 | O | O | O | O |
| Ex. 5 | No. 5 | O | O | O | O |
| Ex. 6 | No. 6 | O | O | O | O |
| Ex. 7 | No. 7 | O | O | O | O |
| Comp. Ex. 1 | Comp. No. 1 | O | X | X | X |
| Comp. Ex. 2 | Comp. No. 2 | X | O | O | Δ |
| Com. Ex. 3 | Comp. No. 3 | Δ | Δ | Δ | O |

O: Transferred images underwent almost no change.
Δ: Transferred images slightly disappeared.
X: Transferred images completely disappeared.

SCRATCH RESISTANCE TEST

The image transfer layer of each of the above-prepared thermal image transfer recording media was brought into close contact with a sheet of mirror coated paper, and bar codes were transferred thereto using a thermal transfer printer by application of a thermal energy of 0.6 mJ/dot.

In order to evaluate the scratch resistance of the transferred bar code images, a specific portion of the transferred bar codes was reciprocating scanned, 10 times at maximum, by using a pen scanner "SD-3000", made by OPTO Electronics Co., Ltd.) until the bar codes could not be read, so that the number of the scanning by which the bar codes remained readable was counted. The results are shown in Table 2.

TABLE 2

| | Recording Medium | Number of Readable Scanning Times |
|---|---|---|
| Example 1 | No. 1 | 10 |
| Example 2 | No. 2 | 10 |
| Example 3 | No. 3 | 10 |
| Example 4 | No. 4 | 10 |
| Example 5 | No. 5 | 10 |
| Example 6 | No. 6 | 10 |
| Example 7 | No. 7 | 10 |
| Comp. Example 1 | Comp. No. 1 | 2 |
| Comp. Example 2 | Comp. No. 2 | 8 |
| Comp. Example 3 | Comp. No. 3 | 2 |

FRICTION RESISTANCE TEST

Images were transferred to a sheet of mirror coated paper in the same manner as in Experiment 2, and the friction resistance against corrugated cardboard was tested using a Labtester (made by Toyo Seiki Seisaku-Sho Ltd.). The test conditions were as follows:

| | |
|---|---|
| Load | 100 g/cm$^2$ |
| Temperature | 50° C. |
| Friction times | 100, reciprocatingly. |

The transferred images after the above test were visually observed. The results are shown in Table 3.

TABLE 3

| | Recording Medium | Images after Test |
|---|---|---|
| Example 1 | No. 1 | O |
| Example 2 | No. 2 | O |
| Example 3 | No. 3 | O |

TABLE 3-continued

| | Recording Medium | Images after Test |
|---|---|---|
| Example 4 | No. 4 | O |
| Example 5 | No. 5 | O |
| Example 6 | No. 6 | O |
| Example 7 | No. 7 | O |
| Comp. Example 1 | Comp. No. 1 | X |
| Comp. Example 2 | Comp. No. 2 | Δ |
| Comp. Example 3 | Comp. No. 3 | X |

O: Transferred images were scarcely blotted, and each character was readable.
Δ: Transferred images were slightly blotted, and it was possible to read each character, but with difficulty.
X: Transferred images were blotted, and it was very difficult to read each character.

EXAMPLE 8

The surface of a 3.5 μm thick polyester film with a polyimide theremoresistant layer as backing was hot-melt coated with a peel-off layer made of carnauba wax (Trademark "CW-1" made by Noda Wax Co., Ltd.) so as to be 2 μm in thickness. To this peel-off layer, an ink layer-forming dispersion of the following formulation was applied by a wire-bar, and dried. Thus, Thermal Image Transfer Recording Medium No. 8 according to the present invention, having an ink layer with a thickness of 2 μm, was prepared.

| Formulation of Ink Layer-Forming Dispersion: | |
|---|---|
| Carbon Black | 4.95 g |
| Polyester Resin (9), prepared in Synthesis Example 1 | 10.05 g |
| Toluene | 85 g |

EXAMPLE 9

Example 8 was repeated except that Polyester Resin (9) employed in Example 8 was replaced by Polyester Resin (5) prepared in Synthesis Example 2, whereby Thermal Image Trasfer Recording Medium No. 9 according to the present invention was prepared.

EXAMPLE 10

Example 8 was repeated except that Polyester Resin (9) employed in Example 8 was replaced by Polyester Resin (7) prepared in Synthesis Example 3, whereby Thermal Image Transfer Recording Medium No. 10 according to the present invention was prepared.

EXAMPLE 11

Example 8 was repeated except that Polyester Resin (9) employed in Example 8 was replaced by Polyester Resin (10) prepared in Synthesis Example 4, whereby Thermal Image Transfer Recording Medium No. 11 according to the present invention was prepared.

EXAMPLE 12

Example 8 was repeated except that Polyester Resin (9) employed in Example 8 was replaced by Polyester Resin (12) prepared in Synthesis Example 6, whereby Thermal Image Transfer Recording Medium No. 12 according to the present invention was prepared.

EXAMPLE 13

Example 8 was repeated except that the peel-off layer employed in Example 8 was replaced by a peel-off layer with the following formulation, whereby Thermal Image Transfer Recording Medium No. 13 according to the present invention was prepared.

| Formulation of Peel-off Layer: | |
|---|---|
| Carnauba wax (Trademark "CW-1" made by Noda Wax Co., Ltd.) | 7 g |
| Paraffin wax (Trademark "HNP-10" made by Nippon Seiro Co., Ltd.) | 3 g |

EXAMPLE 14

Example 13 was repeated except that Polyester Resin (9) employed in Example 13 was replaced by Polyester Resin (5) prepared in Synthesis Example 2, whereby Thermal Image Transfer Recording Medium No. 14 according to the present invention was prepared.

EXAMPLE 15

Example 13 was repeated except that Polyester Resin (9) employed in Example 13 was replaced by Polyester Resin (7) prepared in Synthesis Example 3, whereby Thermal Image Transfer Recording Medium No. 15 according to the present invention was prepared.

EXAMPLE 16

Example 13 was repeated except that Polyester Resin (9) employed in Example 13 was replaced by Polyester Resin (10) prepared in Synthesis Example 4, whereby Thermal Image Transfer Recording Medium No. 16 according to the present invention was prepared.

EXAMPLE 17

Example 13 was repeated except that Polyester Resin (9) employed in Example 13 was replaced by Polyester Resin (12) prepared in Synthesis Example 6, whereby Thermal Image Transfer Recording Medium No. 17 according to the present invention was prepared.

The image transfer layer of each of the above-prepared thermal image transfer recording media was brought into close contact with a surface of a high-quality paper, and images were transferred using a thermal transfer printer by application of a thermal energy of 0.6 mJ/dot.

The sharpness of the transferred images was visually observed. Further, in order to evaluate the solvent resistance thereof, the above-prepared thermal image transfer recording media were subjected to the same solvent resistance test as mentioned previously. The results are shown in Table 4.

TABLE 4

| Ex. No. | 8 | 9 | 10 | 11 | 12 | 13 | 14 | 15 | 16 | 17 |
|---|---|---|---|---|---|---|---|---|---|---|
| Sharpness of Transferred Image | O | O | O | O | O | O | O | O | O | O |
| Ethanol Resist. | O | O | O | O | O | O | O | O | O | O |
| Kerosene Resist. | O | O | O | O | O | O | O | O | O | O |
| Engine Oil Resist. | O | O | O | O | O | O | O | O | O | O |
| Car Wax Resist. | O | O | O | O | O | O | O | O | O | O |

Sharpness of Transferred Images:
O: Clear and highly resoluted, just like typographed images.
Δ: Not so clear, but each character was readable.
X: Not clear at all, and characters were not readable.
Solvent Resistance Test:
O: Transferred images underwent almost no change.
Δ: Transferred images disappeared in some degree.
X: Transferred images completely disappeared.

Further, the above-prepared thermal image transfer recording media were subjected to the same scratch resistance test as mentioned previously.

The results are shown in Table 5.

Furthermore, the above-prepared thermal image transfer recording media were subjected to the same friction resistance test as mentioned previously. The results are shown in Table 5.

TABLE 5

| | Recording Medium | No. of Readable Scanning Times | Images after Friction Resistance Test |
|---|---|---|---|
| Ex. 8 | No. 12 | 10 | O |
| Ex. 9 | No. 13 | 10 | O |
| Ex. 10 | No. 14 | 10 | O |
| Ex. 11 | No. 15 | 10 | O |
| Ex. 12 | No. 16 | 10 | O |
| Ex. 13 | No. 17 | 10 | O |
| Ex. 14 | No. 18 | 10 | O |
| Ex. 15 | No. 19 | 10 | O |
| Ex. 16 | No. 20 | 10 | O |
| Ex. 17 | No. 21 | 10 | O |

Images after Friction Test:
O: Transferred images were scarcely blotted, and each character was readable.
Δ: Transferred images were slightly blotted, and it was possible to read each character, but with difficulty.
X: Transferred images were blotted, and it was very difficult to read each character.

EXAMPLE 18

To the surface of a 3.5 μm thick polyester film with a polyimide thermoresistant layer as backing, an ink layer-forming dispersion having the following formulation was applied by using a wire-bar, and dried. Thus, Thermal Image Transfer Recording Medium No. 18 according to the present invention, having an ink layer with a thickness of 2 μm, was prepared.

| Formulation of Ink Layer-Forming Dispersion: | |
|---|---|
| Carbon Black | 4.5 g (30% of the total solid components in the ink) |
| Thermoplastic Saturated Linear Polyester Resin | 10.5 g (70% of the total solid components in the ink) $-[OC(CH_2)_4COO(CH_2)_{10}O]-$ Molecular Weight: 30,000 Melting Point: 72 to 74° C. |
| Toluene | 85 g |

EXAMPLE 19

Example 18 was repeated except that the thermoplastic saturated linear polyester resin employed in Example 18 was replaced by "VYRON-300" (made by Toyobo Co., Ltd.), whereby Thermal Image Transfer Recording Medium No. 19 according to the present invention was prepared.

EXAMPLE 20

Example 18 was repeated except that the thermoplastic saturated linear polyester resin employed in Example 18 was replaced by "TP-220" (made by The Nippon Synthetic Chemicals Industry Co., Ltd.) and a peel-off layer made of paraffin wax, having a thickness of 2 μm, was formed between the ink layer and the substrate, whereby Thermal Image Transfer Recording Medium No. 20 according to the present invention was prepared.

EXAMPLE 21

Example 18 was repeated except that the ink layer-forming composition employed in Example 18 was replaced by an ink layer-forming composition having the following formulation, and a peel-off layer made of paraffin wax, having a thickness of 2 μm, was formed between the ink layer and the substrate, whereby Thermal Image Trasfer Recording Medium No. 21 according to the present invention was prepared.

| Formulation of Ink Layer-Forming Composition: | |
|---|---|
| Carbon Black | 7.5 g (50% of the total solid components in the ink) |
| Thermoplastic Saturated Linear Polyester Resin | 7.5 g (50% of the total solid components in the ink) $-[OC(CH_2)_4COO(CH_2)_{10}O]_n-$ Molecular Weight: 30,000 Melting Point: 72 to 74° C. |
| Toluene | 85 g |

The above-prepared thermal image transfer recording media were subjected to a visual inspection of the dispersion of the carbon black particles in the transferred images, the same solvent resistance test, and the same friction test as mentioned previously. The results are shown in Table 6.

TABLE 6

| | Ex. 18 | Ex. 19 | Ex. 20 | Ex. 21 |
|---|---|---|---|---|
| Dispersibility | O | O | O | O |
| Ethanol Resistance | O | O | O | O |
| Kerosene Resistance | O | O | O | O |
| Engine Oil Resistance | O | O | O | O |
| Car Wax Resistance | O | O | O | O |
| No. of Readable Scanning Times | 10 | 10 | 10 | 10 |
| Images after Friction Resistance Test | O | O | O | O |

Dispersability:
O: Particles of carbon black were invisible, and homogeneously dispersed, with high image density.
Δ: Some particles of carbon black were visible, and inhomogeneous, with low image density as a whole.
X: Particles of carbon black were well visible, with extremely low image density.
Solvent Resistance
O: Transferred images under went almost no change.
Images after Friction Resistance Test:
O: Transferred images were scarcely blotted, and each character was readable.

EXAMPLE 22

To the surface of a 3.5 μm thick polyester film with a polyimide thermoresistant layer as backing, an ink layer-forming composition of the following formulation was applied by a wire-bar, and dried.

Thus, Thermal Image Transfer Recording Medium No. 22 according to the present invention, having a thermofusible ink layer with a thickness of 3.5 μm, was prepared.

| Formulation of Ink Layer-Forming Composition: | |
|---|---|
| Carbon Black | 0.99 g |
| Polyester Resin (29), prepared in Synthesis Example 8 | 2.01 g |
| Toluene | 17.0 g |

EXAMPLE 23

Example 22 was repeated except that Polyester Resin (29) employed in Example 22 was replaced by Polyester Resin (31) prepared in Synthesis Example 9, whereby Thermal Image Transfer Recording Medium No. 23 according to the present invention was prepared.

EXAMPLE 24

Example 22 was repeated except that Polyester Resin (29) employed in Example 22 was replaced by Polyester Resin (33) prepared in Synthesis Example 10, whereby Thermal Image Transfer Recording Medium No. 24 according to the present invention was prepared.

EXAMPLE 25

Example 22 was repeated except that Polyester Resin (29) employed in Example 22 was replaced by Polyester Resin (35) prepared in Synthesis Example 11, whereby Thermal Image Transfer Recording Medium No. 25 according to the present invention was prepared.

EXAMPLE 26

Example 22 was repeated except that Polyester Resin (29) employed in Example 22 was replaced by Polyester Resin (36) prepared in Synthesis Example 12, whereby Thermal Image Transfer Recording Medium No. 26 according to the present invention was prepared.

The above-prepared thermal image transfer recording media No. 18 to No. 26 were subjected to the same solvent resistance test, the same scratch resistance test, and the same friction resistance test as mentioned previously. The results were as good as those of the thermal image transfer recording media No. 1 through No. 17.

The above-prepared thermal image transfer recording media were subjected to the same scratch resistance test as mentioned previously.

EXAMPLE 27

To the surface of a 3.5 μm thick polyester film carrying a polyimide thermoresistant layer as backing, an ink layer forming composition of the following formulation was applied by a wire-bar, and dried. Thus, Thermal Image Transfer Recording Medium No. 27 according to the present invention, having a thermofusible ink layer with a thickness of 3.5 μm was prepared.

| Formulation of Ink Layer-Forming Composition: | |
|---|---|
| Carbon Black | 0.99 g |
| Polyester Resin (9), Prepared in Synthesis Example 1 | 1.005 g |
| Carnauba Wax (m.p.: 82° C., penetration of less than 1) | 1.005 g |
| Toluene | 17.0 g |

EXAMPLE 28

Example 27 was repeated except that Polyester Resin (9) employed in Example 1 was replaced by Polyester Resin (5) prepared in Synthesis Example 2, whereby Thermal Image Transfer Recording Medium No. 28 according to the present invention was prepared.

EXAMPLE 29

Example 27 was repeated except that Polyester Resin (9) employed in Example 1 was replaced by Polyester Resin (7) prepared in Synthesis Example 3, whereby Thermal Image Transfer Recording Medium No. 29 according to the present invention was prepared.

EXAMPLE 30

Example 27 was repeated except that Polyester Resin (9) employed in Example 1 was replaced by Polyester Resin (10) prepared in Synthesis Example 4, whereby Thermal Image Transfer Recording Medium No. 30 according to the present invention was prepared.

EXAMPLE 31

Example 27 was repeated except that Polyester Resin (9) employed in Example 1 was replaced by Polyester Resin (11) prepared in Synthesis Example 5, whereby Thermal Image Transfer Recording Medium No. 31 according to the present invention was prepared.

EXAMPLE 32

Example 27 was repeated except that Polyester Resin (9) employed in Example 1 was replaced by Polyester Resin (12) prepared in Synthesis Example 6, whereby Thermal Image Transfer Recording Medium No. 32 according to the present invention was prepared.

EXAMPLE 33

Example 27 was repeated except that Polyester Resin (9) employed in Example 1 was replaced by Polyester Resin (2) prepared in Synthesis Example 7, whereby Thermal Image Transfer Recording Madium No. 33 according to the present invention was prepared.

EXAMPLE 34

Example 27 was repeated except that the carnauba wax employed in Example 27 was replaced by a polyethylene wax having a melting point of 98° C. and a penetration of 1, whereby Thermal Image Transfer Recording Medium No. 34 according to the present invention was prepared.

EXAMPLE 35

Example 27 was repeated except that the carnauba wax employed in Example 27 was replaced by a polyethylene wax having a melting point of 128° C. and a penetration of 1, whereby Thermal Image Transfer Recording Medium No. 35 according to the present invention was prepared.

EXAMPLE 36

Example 27 was repeated except that the carnauba wax employed in the Example 27 was replaced by Fisher tropish wax having a melting point of 108° C. and a penetration of 1, whereby Thermal Image Transfer Recording Medium No. 36 according to the present invention was prepared.

COMPARATIVE EXAMPLE 4

Example 27 was repeated except that the polyester resin and the carnauba wax employed in Example 27 were replaced by carnauba wax, whereby Comparative Thermal Image Transfer Recording Medium No. 4 was prepared.

The above prepared Thermal Image Transfer Recording Media No. 27 to No. 36 according to the present invention and Comparative Thermal Image Transfer Recording Medium No. 4 were subjected to the same solvent resistance test, the same scratch resistance test and the same friction resistance test as mentioned previously.

The result was that Thermal Image Transfer Recording Media No. 27 to No. 36 were as good as the previously mentioned thermal image transfer recording media according to the present invention. With respect to Comparative Thermal Image Transfer Recording Medium No. 4, the transferred images were scarcely changed in contact with enthanol, slightly disappeared in contact with kerosine, and engine oil, and completely disappeared in contact with car wax in the solvent resistance test, underwent no changes in the scratch resistance test, and were not so clear, but readable in the friction resistance test.

With respect to the resolution of the transferred images, Image Transfer Recording Media No. 27 through No. 36 and Comparative Image Transfer Recording Medium No. 4 were excellent, yielding clear images with high resolution.

What is claimed is:

1. A thermal image transfer recording medium comprising a substrate and a thermally transferrable ink layer formed thereon comprising as the main components a carbon black and a fusible saturated linear polyester resin, further comprising a peel-off layer between said substrate and said thermally transferrable ink layer, wherein said peel-off layer is made of a thermofusible material having a differential thermal analysis peak at 120° C. or less selected from the group consisting of beeswax, whale wax, candelilla wax, carnauba was, rice bran wax, montan wax, ozocerite wax, paraffin wax and microcrystalline wax.

2. The thermal image transfer recording medium as claimed in claim 1, wherein said saturated linear polyester resin has a melting point or a softening point of 50° to 200° C.

3. The thermal image transfer recording medium as claimed in claim 2, wherein said saturated linear polyester resin has a melting point or a softening point of 50° to 150° C.

4. The thermal image trasfer recording medium as claimed in claim 3, wherein said saturated linear polyester resin has a melting point or a softening point of 60° to 120° C.

5. The thermal image transfer recording medium as claimed in claim 1, wherein said saturated linear polyester resin has a number average molecular weight of 3,000 to 30,000.

6. The thermal image transfer recording medium as claimed in claim 5, wherein said saturated linear polyester resin has a number average molecular weight of 4,000 to 20,000.

7. The thermal image transfer recording medium as claimed in claim 1, wherein said saturated linear polyester resin contains repeating units of the general formula (I):

$$-(OC-R^1-COO-R^2-O)- \quad (I)$$

wherein $R^1$ and $R^2$ independently represent a saturated linear aliphatic hydrocarbon group having 2 to 18 carbon atoms, and the total number of carbon atoms contained in $R^1$ and $R^2$ is 8 or more.

8. The thermal image transfer recording medium as claimed in claim 1, wherein said saturated linear polyester resin contains repeating units of the following general formula (II):

$$-(OC-R^3-COO-R^4-O)- \quad (II)$$

wherein $R^3$ represents a saturated linear aliphatic hydrocarbon group, $R^4$ represents a saturated linear aliphatic hydrocarbon group containing ether groups or a saturated linear aliphatic hydrocarbon group, and the molar ratio of said saturated linear aliphatic hydrocarbon group containing ether groups to said saturated linear aliphatic hydrocarbon group represented by $R^4$ in said saturated linear polyester resin is 1–100:99–0.

9. The thermal image transfer recording medium as claimed in claim 1, wherein said thermally transferrable color layer further comprises a wax component having a penetration of 1 or less at 25° C.

10. The thermal image transfer recording medium as claimed in claim 9, wherein the amount of said wax to the amount of said polyester resin is in the range of (20:80) to (80:20).

11. The thermal image transfer recording medium as claimed in claim 1, wherein said peel-off layer has a thickness of 0.1 to 10 μm.

12. The thermal image transfer recording medium as claimed in claim 11, wherein said peel-off layer has a thickness of 1 to 5 μm.

13. The thermal image transfer recording medium as claimed in claim 1, wherein said ink layer has a thickness of 0.1 to 30 μm.

14. The thermal image transfer recording medium as claimed in claim 13, wherein said ink layer has a thickness of 1 to 20 μm.

* * * * *

UNITED STATES PATENT AND TRADEMARK OFFICE

CERTIFICATE OF CORRECTION

PATENT NO. : 4,983,446

DATED : JANUARY 8, 1991

INVENTOR(S) : KEISHI TANIGUCHI ET AL

It is certified that error appears in the above-identified patent and that said Letters Patent is hereby corrected as shown below:

Column 1, lines 43 and 44, delete "transferrable", insert --transferable--;
line 57, delete "independendly", insert --independently--.

Column 3, line 43, delete "are", insert --is--.

Column 4, line 6, delete "oragnic", insert -organic--;
lines 64 and 65, delete "transferrable", insert -transferable--.

Column 6, line 35, delete "Rresin", insert --Resin--;
line 53, delete "condencer", insert --condenser--.

Column 8, line 33, before "Trademark", insert --(--.

Column 9, line 31, before "SD-3000", insert --(--.

Column 10, line 39, delete "Trasfer", insert --Transfer--.

Column 13, line 19, delete "Trasfer", insert --Transfer--;
line 56, delete "under went", insert --underwent--.

Column 16, line 29, delete "transferrable, insert --transferable--;
line 33, delete "transferrable, insert --transferable--.
line 37, delete "was", insert --wax--
line 48, delete "trasfer", insert --transfer--.

UNITED STATES PATENT AND TRADEMARK OFFICE

CERTIFICATE OF CORRECTION

PATENT NO. : 4,983,446

DATED : JANUARY 8, 1991

INVENTOR(S) : KEISHI TANIGUCHI ET AL

It is certified that error appears in the above-identified patent and that said Letters Patent is hereby corrected as shown below:

Column 17, line 19, delete "transferrable", insert --transferable--.

Signed and Sealed this

Twentieth Day of July, 1993

*Attest:*

Michael K. Kirk

MICHAEL K. KIRK

*Attesting Officer*

*Acting Commissioner of Patents and Trademarks*